US011145239B2

(12) United States Patent
Pyun et al.

(10) Patent No.: US 11,145,239 B2
(45) Date of Patent: Oct. 12, 2021

(54) DISPLAY DEVICE AND METHOD OF DRIVING THE SAME

(71) Applicant: Samsung Display Co., LTD., Yongin-si (KR)

(72) Inventors: Ki Hyun Pyun, Yongin-si (KR); Jang Hoon Kwak, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/894,157

(22) Filed: Jun. 5, 2020

(65) Prior Publication Data

US 2021/0125541 A1 Apr. 29, 2021

(30) Foreign Application Priority Data

Oct. 23, 2019 (KR) ..... 10-2019-0132431

(51) Int. Cl.
*G09G 3/20* (2006.01)

(52) U.S. Cl.
CPC ..... *G09G 3/2092* (2013.01); *G09G 2310/027* (2013.01); *G09G 2310/08* (2013.01)

(58) Field of Classification Search
CPC ..... G09G 3/2092; G09G 2310/08; G09G 2310/027; G09G 2310/0262; G09G 2310/0251; G09G 2300/0861; G09G 3/3233
See application file for complete search history.

(56) References Cited

U.S. PATENT DOCUMENTS

| | | | | |
|---|---|---|---|---|
| 9,941,018 | B2 | 4/2018 | Hong et al. | |
| 10,102,803 | B2 | 10/2018 | Park et al. | |
| 10,504,442 | B2 | 12/2019 | Yoo | |
| 2013/0033481 | A1* | 2/2013 | Kang | G09G 3/3648 345/215 |
| 2013/0093798 | A1* | 4/2013 | Kang | G09G 3/3648 345/690 |
| 2014/0354625 | A1* | 12/2014 | Shin | G09G 3/3648 345/215 |
| 2017/0004785 | A1* | 1/2017 | Qi | G09G 3/3611 |
| 2019/0005889 | A1 | 1/2019 | Kwon et al. | |
| 2019/0035868 | A1 | 1/2019 | Choi et al. | |
| 2019/0103049 | A1 | 4/2019 | Noh et al. | |
| 2021/0005145 | A1* | 1/2021 | Lee | G09G 3/3233 |

FOREIGN PATENT DOCUMENTS

| | | |
|---|---|---|
| KR | 10-1661026 | 9/2016 |
| KR | 10-2018-0068368 | 6/2018 |

* cited by examiner

*Primary Examiner* — Andrew Sasinowski
(74) *Attorney, Agent, or Firm* — Kile Park Reed & Houtteman PLLC

(57) ABSTRACT

A display device includes a display panel including gate lines, data lines, and pixels; a gate driver that provides gate signals to the pixels through the gate lines; a data driver that provides data signals to the pixels through the data lines; and a timing controller that obtains pre-charging gray scale values based on gray scale values of the pixels. The gate driver simultaneously supplies the gate signals to the gate lines in a first period, and sequentially supplies the gate signals to the gate lines in a second period. The data driver supplies data signals corresponding to the pre-charging gray scale values to the data lines in the first period, and supplies data signals corresponding to the gray scale values of the pixels to the data lines in the second period.

20 Claims, 12 Drawing Sheets

| | | | | | | |
|---|---|---|---|---|---|---|
| RV1 | 58G | 21G | 149G | 138G | 74G | 74G |
| RV2 | 64G | 64G | 127G | 127G | 127G | 127G |
| RV3 | 64G | 64G | 127G | 127G | 127G | 127G |

| | | | | | | |
|---|---|---|---|---|---|---|
| RV1 | 101G | 74G | 170G | 180G | 32G | 32G |
| RV2 | 127G | 127G | 63G | 95G | 64G | 64G |
| RV3 | 127G | 127G | 191G | 159G | 64G | 64G |

| | | | | | | |
|---|---|---|---|---|---|---|
| RV1 | 90G | 21G | 85G | 191G | 5G | 170G |
| RV2 | 48G | 32G | 32G | 63G | 16G | 63G |
| RV3 | 80G | 32G | 96G | 191G | 16G | 191G |

| | | | | | | |
|---|---|---|---|---|---|---|
| RV1 | 101G | 13G | 96G | 212G | 10G | 191G |
| RV2 | 127G | 32G | 32G | 63G | 32G | 63G |
| RV3 | 127G | 32G | 96G | 191G | 32G | 191G |

DISPLAY DEVICE AND METHOD OF DRIVING THE SAME

CROSS-REFERENCE TO RELATED APPLICATION(S)

This application claims priority to and benefits of Korean patent application No. 10-2019-0132431 under 35 U.S.C. § 119, filed in the Korean Intellectual property Office on Oct. 23, 2019, the entire contents of which are incorporated herein by reference.

BACKGROUND

Technical Field

The disclosure relates to a display device and a method of driving the same.

Description of Related Art

A display device may include a display panel, a gate driver, a data driver, and a timing controller. The display panel may include gate lines, data lines, and pixels. The gate driver may provide gate signals to pixels through the gate lines. The data driver may provide data voltages to the pixels through the data lines. The timing controller may control a driving timing of each of the gate driver and the data driver.

If the resolution of the display device is increased and the driving frequency thereof is increased, the time (for example, gate on time) for which a switching element of a pixel may be turned on by a gate signal may be reduced, so that charging time of a data voltage may be reduced. Thereby, a charging rate (or a charging time) of the pixel may be reduced.

It is to be understood that this background of the technology section is, in part, intended to provide useful background for understanding the technology. However, this background of the technology section may also include ideas, concepts, or recognitions that were not part of what was known or appreciated by those skilled in the pertinent art prior to a corresponding effective filing date of the subject matter disclosed herein.

SUMMARY

Embodiments of the disclosure are directed to a display device capable of enhancing the charging rate of a pixel, and a method of driving the display device.

Embodiments of the disclosure are directed to a display device capable of charging a desired data voltage to the pixel regardless of a data voltage charged in a previous frame (N−1 Frame, for example), and a method of driving the display device.

An embodiment of the disclosure may provide a display device including: a display panel including gate lines, data lines, and pixels; a gate driver that may provide gate signals to the pixels through the gate lines; a data driver that may provide data signals to the pixels through the data lines; and a timing controller that may obtain pre-charging gray scale values based on gray scale values of the pixels. The gate driver may simultaneously supply the gate signals to the gate lines in a first period, and sequentially supply the gate signals to the gate lines in a second period. The data driver may supply data signals corresponding to the pre-charging gray scale values to the data lines in the first period, and supply data signals corresponding to the gray scale values of the pixels to the data lines in the second period.

In an embodiment, the gate driver may simultaneously supply the gate signals to a predetermined number of gate lines in the first period.

In an embodiment, the gate lines may include first to k-th groups. The gate driver may simultaneously supply the gate signals to gate lines included in a p-th group among the first to k-th groups in the first period, and sequentially supply the gate signals to the gate lines included in the p-th group in the second period. Here, k may be a natural number of 2 or more, and p may be a natural number of 1 or more.

In an embodiment, a first frame period may include first to k-th sub-frame periods. A p-th sub-frame period among the first to k-th sub-frame periods may include the first period and the second period.

In an embodiment, a first pre-charging gray scale value corresponding to a data signal supplied to a first data line among the data lines may be obtained based on gray scale values of the pixels electrically connected to the first data line and the gate lines included in the p-th group.

In an embodiment, the first pre-charging gray scale value may be an average value of the gray scale values of the pixels electrically connected to the first data line and the gate lines included in the p-th group.

In an embodiment, the first pre-charging gray scale value may be a half of a value obtained by subtracting a minimum value of the gray scale values of the pixels electrically connected to the first data line and the gate lines included in the p-th group from a maximum value of the gray scale values.

In an embodiment, the first pre-charging gray scale value may be an average value of a maximum value and a minimum value of the gray scale values of the pixels electrically connected to the first data line and the gate lines included in the p-th group.

In an embodiment, the timing controller may generate first to q-th gate clock signals. The gate driver may generate the gate signals based on the first to q-th gate clock signals. Here, q may be a natural number of 2 or more.

In an embodiment, each of the first to q-th gate clock signals may include pulses that may be simultaneously formed in a same section during the first period, and may be sequentially formed in different sections during the second period.

In an embodiment, the gate lines included in the p-th group may be adjacent to each other, and the number of the gate lines included in the p-th group may be a multiple of q.

In an embodiment, pulse widths of the gate signals that may be simultaneously supplied to the gate lines included in the p-th group in the first period may be equal to pulse widths of the gate signals that may be sequentially supplied to the gate lines included in the p-th group in the second period.

In an embodiment, pulse widths of the gate signals that may be simultaneously supplied to the gate lines included in the p-th group in the first period may be less than pulse widths of the gate signals that may be sequentially supplied to the gate lines included in the p-th group in the second period.

An embodiment of the disclosure may provide a method of driving a display device, including: obtaining pre-charging gray scale values based on gray scale values of pixels; simultaneously supplying gate signals to gate lines included in a p-th group among first to k-th groups in a first period; supplying data signals corresponding to the pre-charging gray scale values to data lines in the first period; sequentially supplying the gate signals to the gate lines included in the p-th group in a second period; and supplying data signals corresponding to gray scale values of the pixels to the data lines in the second period. Here, p may be a natural number of 1 or more, and k may be a natural number of 2 or more In an embodiment, a first pre-charging gray scale value corresponding to a data signal supplied to a first data line among the data lines may be an average value of gray scale values of the pixels electrically connected to the first data line and the gate lines included in the p-th group.

In an embodiment, a first pre-charging gray scale value corresponding to a data signal supplied to a first data line among the data lines may be a half of a value obtained by subtracting a minimum value of gray scale values of the pixels electrically connected to the first data line and the gate lines included in the p-th group from a maximum value of the gray scale values.

In an embodiment, a first pre-charging gray scale value corresponding to a data signal supplied to a first data line among the data lines may be an average value of a maximum value and a minimum value of gray scale values of the pixels electrically connected to the first data line and the gate lines included in the p-th group.

In an embodiment, the method may further include: generating first to q-th gate clock signals and generating the gate signals based on the first to q-th gate clock signals. Each of the first to q-th gate clock signals may include pulses that may be simultaneously formed in a same section during the first period, and be sequentially formed in different sections during the second period. Here, q may be a natural number of 2 or more.

In an embodiment, the gate lines included in the p-th group may be adjacent to each other, and the number of the gate lines included in the p-th group may be a multiple of q.

In an embodiment, pulse widths of the gate signals that may be simultaneously supplied to the gate lines included in the p-th group in the first period may be less than or equal to pulse widths of the gate signals that may be sequentially supplied to the gate lines included in the p-th gate line group in the second period.

BRIEF DESCRIPTION OF THE DRAWINGS

The above and other features will become more apparent by describing in further detail embodiments thereof with reference to the accompanying drawings, in which.

DETAILED DESCRIPTION OF THE EMBODIMENTS

Figure 1:
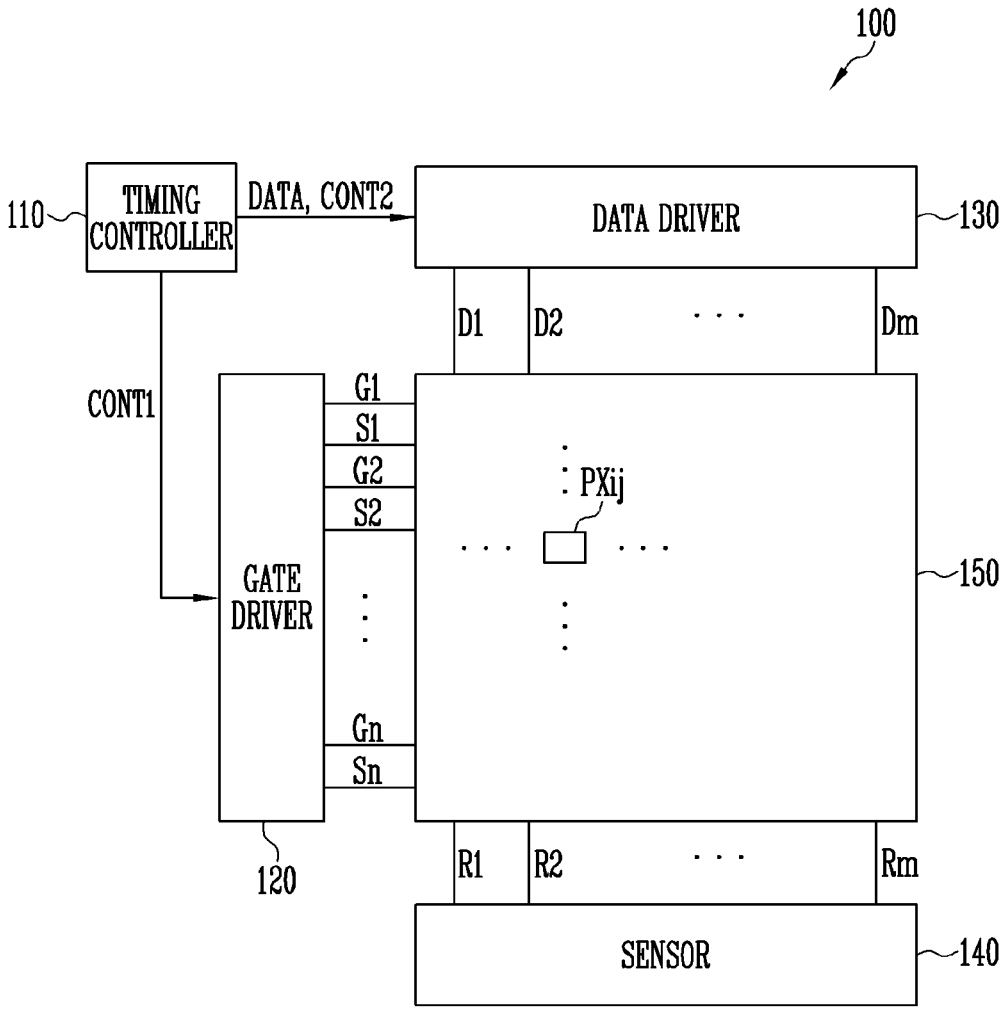
FIG. 1 is a diagram illustrating a display device in accordance with an embodiment.

Although the disclosure may be modified in various manners and have additional embodiments, embodiments are illustrated in the accompanying drawings and will be mainly described in the specification. However, the scope of the disclosure is not limited to the embodiments in the accompanying drawings and the specification and should be construed as including all of the changes, equivalents, and substitutions included in the spirit and scope of the disclosure.

In order to clearly describe the disclosure, parts that are not related to the description are omitted, and the same or similar components are denoted by the same reference numerals throughout the specification. Therefore, the above-described reference numerals may be used in other drawings.

In addition, sizes and thicknesses of elements shown in the drawings are arbitrarily shown for convenience of description, and thus the disclosure is not necessarily limited to those shown in the drawings. In the drawings, thicknesses may be exaggerated to clearly express various layers and regions.

Further, in the specification, the phrase "in a plan view" means when an object portion is viewed from above, and the phrase "in a schematic cross-sectional view" means when a schematic cross-section taken by vertically cutting an object portion is viewed from the side. In addition, in this specification, the phrase "on a plane" means viewing a target portion from the top.

Additionally, the terms "overlap" or "overlapped" mean that a first object may be above or below or to a side of a second object, and vice versa. Additionally, the term "overlap" may include layer, stack, face or facing, extending over, covering or partly covering or any other suitable term as would be appreciated and understood by those of ordinary skill in the art. The terms "face" and "facing" mean that a first element may directly or indirectly oppose a second element. In a case in which a third element intervenes between the first and second element, the first and second element may be understood as being indirectly opposed to one another, although still facing each other. When an element is described as 'not overlapping' or 'to not overlap' another element, this may include that the elements are spaced apart from each other, offset from each other, or set aside from each other or any other suitable term as would be appreciated and understood by those of ordinary skill in the art.

It will be understood that when an element such as a layer, film, region, substrate, or area is referred to as being "on" another element, it may be directly on the other element or intervening elements may also be present. In contrast, when an element is referred to as being "directly on" another element, intervening elements may be absent therebetween.

Further when a layer, film, region, substrate, or area, is referred to as being "below" another layer, film, region, substrate, or area, it may be directly below the other layer, film, region, substrate, or area, or intervening layers, films, regions, substrates, or areas, may be present therebetween. Conversely, when a layer, film, region, substrate, or area, is referred to as being "directly below" another layer, film, region, substrate, or area, intervening layers, films, regions, substrates, or areas, may be absent therebetween. Further, "over" or "on" may include positioning on or below an object and does not necessarily imply a direction based upon gravity.

The spatially relative terms "below", "beneath", "lower", "above", "upper", or the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the illustrative term "below" may include both the lower and upper positions. The device may also be oriented in other directions and thus the spatially relative terms may be interpreted differently depending on the orientations.

Throughout the specification, when an element is referred to as being "connected" to another element, the element may be "directly connected" to another element, or "electrically connected" to another element with one or more intervening elements interposed therebetween. It will be further understood that when the terms "comprises," "comprising," "includes" and/or "including" are used in this specification, they or it may specify the presence of stated features, integers, steps, operations, elements and/or components, but do not preclude the presence or addition of other features, integers, steps, operations, elements, components, and/or any combination thereof.

Although the terms "first," "second," and the like are used for describing various components, these components are not confined by these terms. These terms are merely used for distinguishing one component from the other components. Therefore, a first component may be a second component or vice versa according within the spirit and scope of the disclosure.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

In the specification and the claims, the term "and/or" is intended to include any combination of the terms "and" and "or" for the purpose of its meaning and interpretation. For example, "A and/or B" may be understood to mean "A, B, or A and B." The terms "and" and "or" may be used in the conjunctive or disjunctive sense and may be understood to be equivalent to "and/or." In the specification and the claims, the phrase "at least one of" is intended to include the meaning of "at least one selected from the group of" for the purpose of its meaning and interpretation. For example, "at least one of A and B" may be understood to mean "A, B, or A and B."

Unless otherwise defined, all terms used herein (including technical and scientific terms) have the same meaning as commonly understood by those skilled in the art to which this disclosure pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the specification.

Embodiments will hereinafter be described in detail with reference to the accompanying drawings.

FIG. 1 is a diagram illustrating a display device 100 in accordance with an embodiment.

Referring to FIG. 1, the display device 100 may include a timing controller 110, a gate driver 120, a data driver 130, a sensor 140, and a display panel 150.

The display panel 150 may include gate lines G1, G2, . . . , Gn, (n is a positive integer), sensing lines S1, S2, . . . , Sn, data lines D1, D2, . . . , Dm (m is a positive integer), reception lines R1, R2, . . . , Rm, and pixels. Each pixel PXij (i and j each is a positive integer) may be coupled to a corresponding or respective gate line, a corresponding or respective data line, a corresponding or respective sensing line, and a corresponding or receptive reception line. The pixel PXij may refer to a pixel that may be electrically connected or electrically coupled to an i-th gate line and a j-th data line. Each pixel PXij may emit light in response to data voltages supplied thereto through the corresponding or respective data line and gate signals supplied thereto through the corresponding or respective gate line.

The timing controller 110 may provide a first control signal CONT1, for example to the gate driver 120. The first control signal CONT1 may include a vertical start signal, a gate clock signal, within the spirit and the scope of the disclosure.

In an embodiment, the timing controller 110 may generate first to q-th gate clock signals (q may be a natural number of 2 or more). For example, the timing controller 110 may generate first to sixth gate clock signals.

The timing controller 110 may provide a data signal DATA, a second control signal CONT2, for example to the data driver 130. The second control signal CONT2 may include a horizontal start signal, a data clock signal, a load signal, within the spirit and the scope of the disclosure.

In an embodiment, the timing controller 110 may calculate or obtain pre-charging gray scale values based on gray scale values of the pixels. For example, a pre-charging gray scale value may be an average value of the gray scale values of the pixels, a half of a value obtained by subtracting a minimum value from a maximum value, or an average value of the maximum value and the minimum value. The pre-charging gray scale value may be included in the data signal DATA. A configuration for calculating or obtaining the pre-charging gray scale value will be described below with reference to FIGS. 4A to 4D.

The gate driver 120 may generate gate signals and sensing signals based on the first control signal CONT1, for example, provided from the timing controller 110, and respectively provide the gate signals and the sensing signals to the gate lines G1, G2, . . . , Gn and the sensing lines S1, S2, . . . , Sn. For example, the gate driver 120 may respectively and sequentially provide gate signals and sensing signals, each having a turn-on level (or a turn-on voltage level) pulse, to the gate lines G1, G2, . . . , Gn and the sensing lines S1, S2, . . . , Sn. For example, the gate driver 120 may generate scan signals and sensing signals in a scheme of sequentially transmitting a turn-on level pulse to a subsequent stage in response to a gate clock signal. For instance, the gate driver 120 may be in the form of a shift register.

In an embodiment, the gate driver 120 may simultaneously supply gate signals to at least some gate lines of the gate lines G1, G2, . . . , Gn in a first period, and sequentially supply gate signals to the some gate lines in a second period. The some of the gate lines may be a predetermined number of gate lines or a selected number of gate lines.

In an embodiment, the gate lines G1, G2, . . . , Gn may be divided into first to k-th gate line groups (k may be a natural number of 2 or more). The gate driver 120 may simultaneously supply gate signals to gate lines included in a p-th gate line group (p may be a natural number of 1 or more and k or less) among the first to k-th gate line groups in the first period, and sequentially supply gate signals to gate lines included in the p-th gate line group in the second period. Detailed operation of the gate driver 120 will be described below with reference to FIGS. 3A to 3C.

The gate driver 120 may be implemented as an integrated circuit, or may be implemented in a gate-in-panel (GIP) type and may be directly formed on the display panel 150. In some examples, the gate driver 120 may be integrated with the display panel 150.

Depending on a driving type, the gate driver 120 may be located or disposed on only one side of the display panel 150, as illustrated in FIG. 1, or alternatively disposed on each of both sides of the display panel 150.

The data driver 130 may generate data voltages using a data signal DATA, a second control signal CONT2, for example provided from the timing controller 110. The data driver 130 may generate analog data voltages based on a digital data signal DATA. For example, the data driver 130 may sample gray scale values included in the data signal DATA, and apply data voltages corresponding to the gray scale values to the data lines D1, D2, . . . , Dm on a pixel row basis.

In an embodiment, the data driver 130 may supply data voltages corresponding to pre-charging gray scale values calculated or obtained by the timing controller 110 to the data lines D1, D2, . . . , Dm in the first period, and supply data voltages corresponding to gray scale values of the pixels to the data lines D1, D2, . . . , Dm in the second period. Detailed operation of the data driver 130 will be described below with reference to FIGS. 4A to 5B.

The sensor 140 may measure information about characteristics of the pixels based on current or voltage received through the reception lines R1, R2, . . . , Rm. For example, the information about characteristics of the pixels may include mobility information and threshold voltage information of each of driving transistors included in each pixel, and degradation information of each of light emitting elements included in each pixel.

Figure 2:
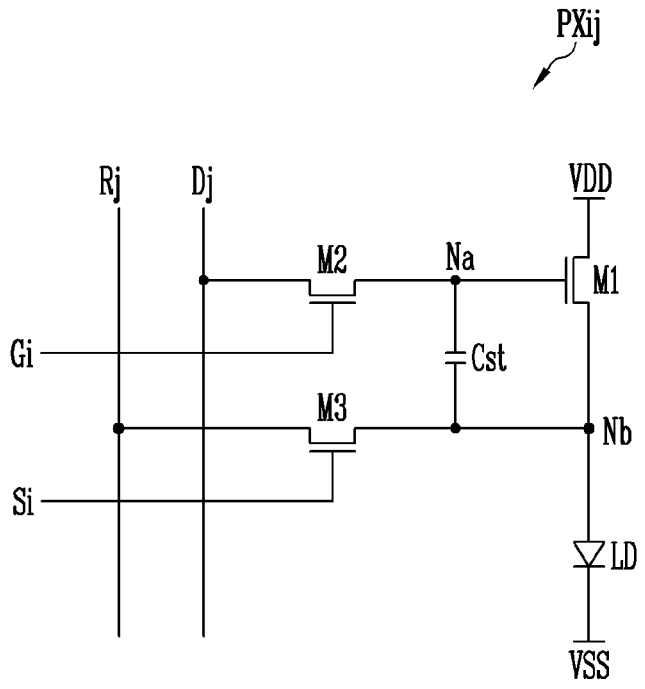
FIG. 2 is an equivalent circuit diagram illustrating a pixel included in the display device of FIG. 1 in accordance with an embodiment.

FIG. 2 is an equivalent circuit diagram illustrating a pixel PXij included in the display device 100 of FIG. 1 in accordance with an embodiment.

Referring to FIG. 2, the pixel PXij may include transistors M1, M2, and M3, a storage capacitor Cst, and a light emitting element LD. Each of the transistors M1, M2, and M3 may be formed of an M-type transistor.

At least one of the transistors M1, M2, and M3 may be formed of an oxide semiconductor thin film transistor including an active layer made of an oxide semiconductor. However, the disclosure is not limited thereto. For example, at least one of the transistors M1, M2, and M3 may be formed of an LTPS thin film transistor including an active layer made of polysilicon.

The first transistor M1 may include a gate electrode electrically connected to or electrically coupled to a first node Na, one electrode (or a first electrode) electrically connected to or electrically coupled to a first power supply line VDD, and the other electrode (or a second electrode) coupled to a second node Nb. The first transistor M1 may be referred to as a driving transistor. The first transistor M1 may control, in response to the voltage of the first node Na, the amount of current flowing from the first power supply line VDD to a second power supply line VSS via the light emitting element LD.

The second transistor M2 may include a gate electrode electrically connected to or electrically coupled to a gate line Gi, a first electrode electrically connected to or electrically coupled to a data line Dj, and a second electrode electrically connected to or electrically coupled to the first node Na. The second transistor M2 may be referred to as a switching transistor, a scan transistor, or the like within the spirit and the scope of the disclosure. When a gate signal having a turn-on level is supplied to the gate line Gi, the second transistor M2 may be turned on so that the data line Dj may be electrically connected to or electrically coupled to the first node Na. Thereby, the second transistor M2 may transmit a data voltage supplied through the data line Dj to the gate electrode (or the first node Na) of the first transistor M1.

The third transistor M3 may include a gate electrode electrically connected to or electrically coupled to a sensing line Si, a first electrode coupled to a reception line Rj, and a second electrode electrically connected to or electrically coupled to the second node Nb. The third transistor M3 may be referred to as an initialization transistor, a sensing transistor, or the like within the spirit and the scope of the disclosure. When a sensing signal having a turn-on level is supplied to the sensing line Si, the third transistor M3 may be turned on so that the reception line Rj may be electrically connected to or electrically coupled with the second electrode (or the second node Nb) of the first transistor M1.

The storage capacitor Cst may include a first electrode electrically connected to or electrically coupled to the first node Na, and a second electrode electrically connected to or electrically coupled to the second node Nb. The storage capacitor Cst may store the voltage of the first node Na. In other words, during a period of time (or a gate-on time) for which the second transistor M2 is turned on in response to a gate signal, a data voltage supplied to the data line Dj may be transmitted to the first node Na, so that the data voltage may be charged to the storage capacitor Cst.

The light emitting diode LD may include an anode coupled to the second node Nb, and a cathode coupled to the second power supply line VSS. The light emitting element LD may emit light at a luminance corresponding to the amount of current supplied thereto through the second node Nb. The light emitting element LD may be formed of an organic light emitting diode or an inorganic light emitting diode but the disclosure is not limited thereto.

Figure 3A:
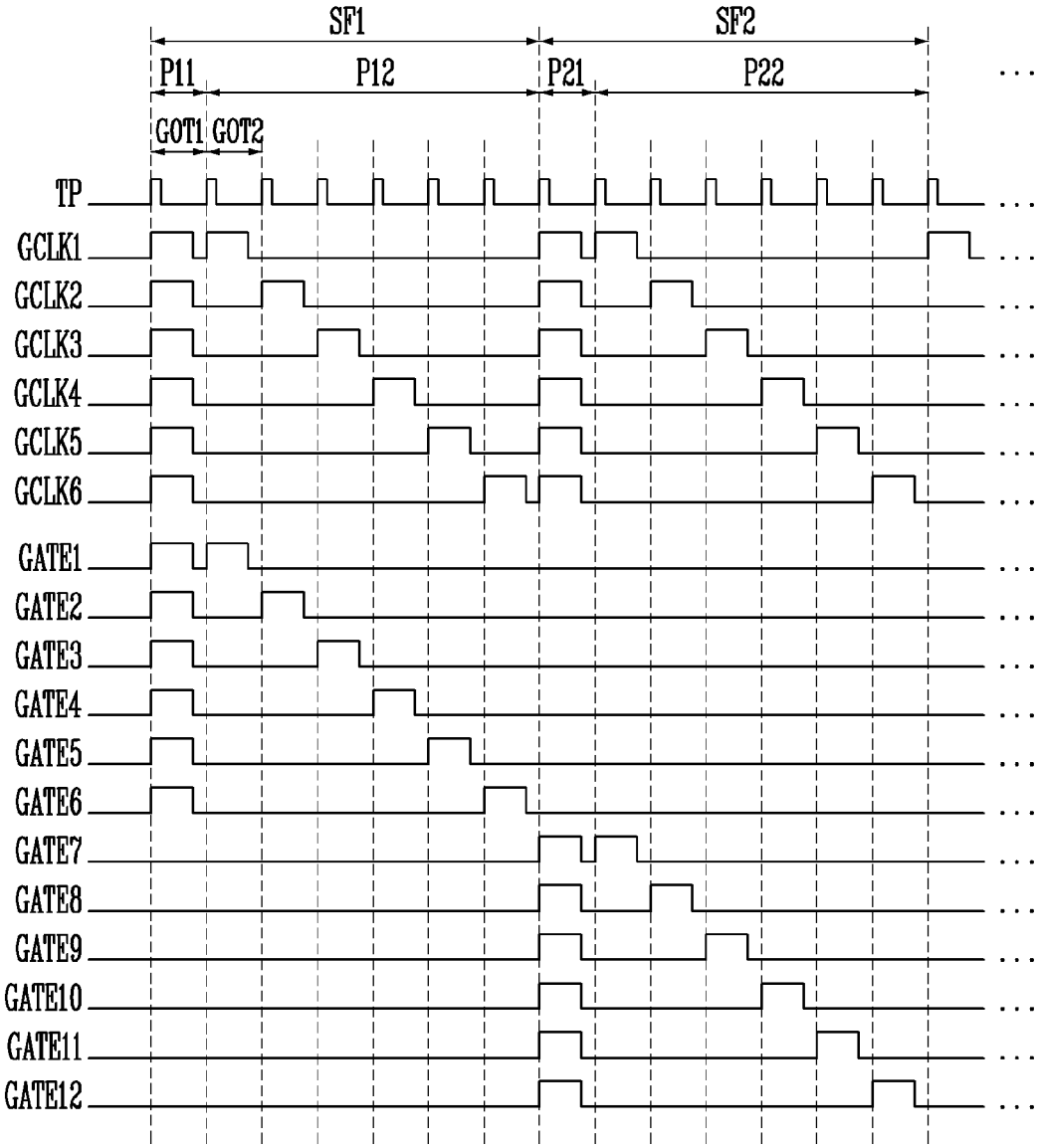
FIG. 3A is a waveform diagram illustrating a load signal, gate clock signals, and gate signals that are measured in the display device of FIG. 1 in accordance with an embodiment.
Figure 3B:
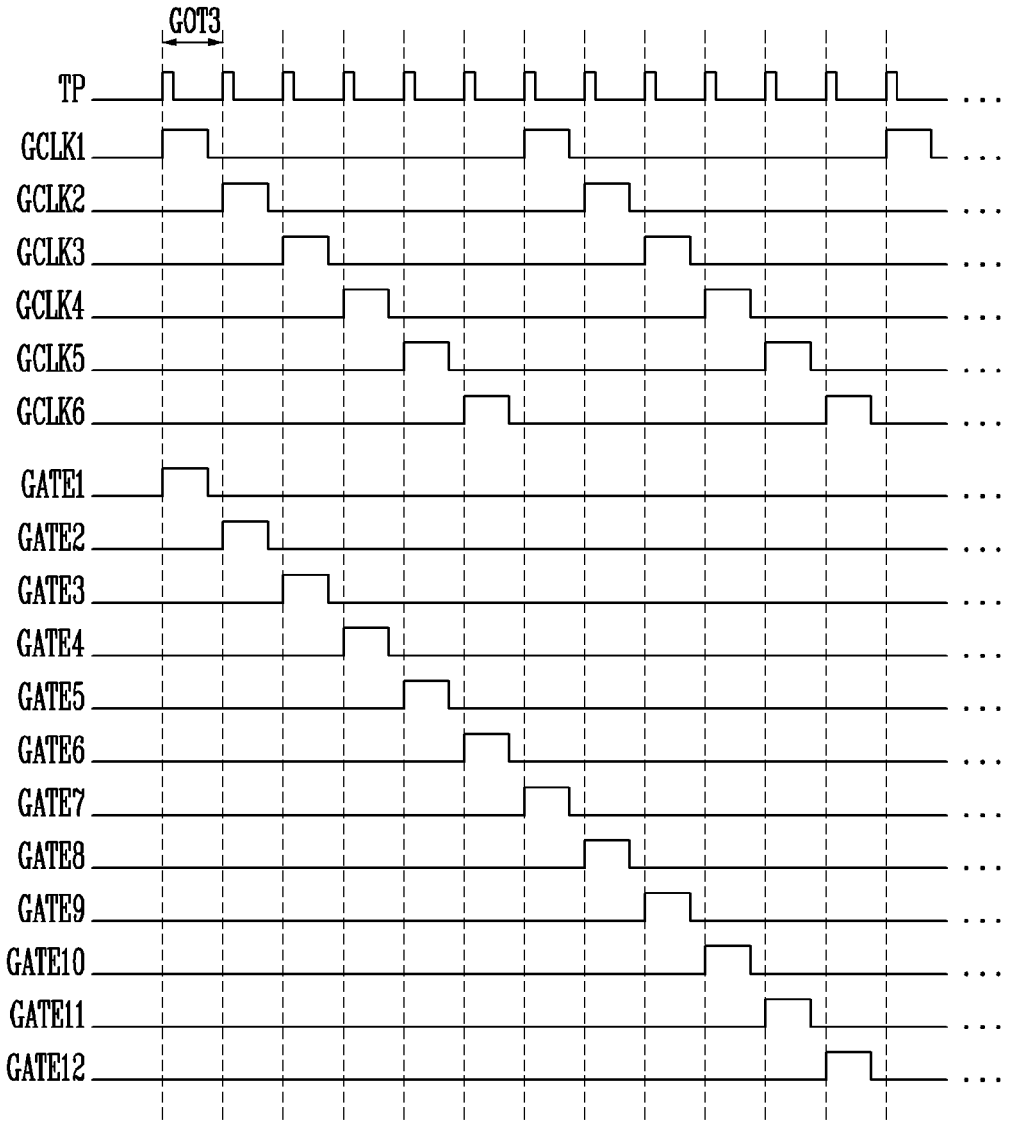
FIG. 3B is a waveform diagram illustrating a load signal, gate clock signals, and gate signals that are measured in the display device of FIG. 1 in accordance with a comparative example.

FIG. 3A is a waveform diagram illustrating a load signal, gate clock signals, and gate signals that may be measured in the display device 100 of FIG. 1 in accordance with an embodiment, and FIG. 3B is a waveform diagram illustrating a load signal, gate clock signals, and gate signals that may be measured in the display device of FIG. 1 in accordance with a comparative example.

Referring to FIGS. 1 and 3A, each frame (1 frame) period may include first to k-th (k may be a natural number of 2 or more) sub-frame periods SF1, SF2, . . . . Each of the first to k-th sub-frame periods SF1, SF2, . . . may include a first period P11, P21, . . . and a second period P21, P22, . . . .

A load signal TP may be a square wave which may be repeated on a regular cycle (or on a cycle corresponding to a gate-on time). In other words, the width of a first gate-on time GOT1 may be the same as that of a second gate-on time GOT2. However, this is only for illustrative purposes, and the disclosure is not limited thereto. For example, the width of the first gate-on time GOT1 may be less than that of the second gate-on time GOT2.

The data driver 130 may generate data voltages based on a load signal TP and a data signal DATA provided from the timing controller 110. In an embodiment, the data voltages may be synchronized with the load signal TP. For example, the data voltages may be output in synchronization with rising edges of logic high level pulses included in the load signal TP. The data driver 130 may sequentially supply data voltages through the data lines D1, D2, . . . , Dm. In detail, the data driver 130 may provide data voltages to pixels electrically connected to or electrically coupled with the first gate line G1, in response to a rising edge of a first logic high level pulse included in the load signal TP. Similarly, the data driver 130 may provide data voltages to pixels electrically connected to or electrically coupled with the second gate line G2, in response to a rising edge of a second logic high level pulse included in the load signal TP.

Turn-on level pulses included in each of gate clock signals GCLK1 to GCLK6 may be formed in synchronization with the load signal TP. For example, the turn-on level pulses included in each of the gate clock signals GCLK1 to GCLK6 may be formed in synchronization with the rising edges of the logic high level pulses included in the load signal TP.

In an embodiment, turn-on level pulses included in the gate clock signals GCLK1 to GCLK6 may be simultaneously formed in a same section during the first period P11 and sequentially formed in different sections in the second period P12. For example, turn-on level pulses included in each of the gate clock signals GCLK1 to GCLK6 may be simultaneously formed in response to the rising edge of the first logic high level pulse of the load signal TP that may be generated in the first period P11. Turn-on level pulses included in each of the gate clock signals GCLK1 to GCLK6 may be sequentially formed in response to rising edges of second to seventh logic high level pulses of the load signal TP that may be generated in the second period P12.

The gate driver 120 may generate gate signals GATE1, GATE2, . . . based on the gate clock signals GCLK1 to GCLK6.

In an embodiment, the gate driver 120 may simultaneously supply gate signals to at least some gate lines of the gate lines G1, G2, . . . , Gn in the first period P11, and sequentially supply gate signals to the some gate lines in the second period P12. The some of the gate lines may be a predetermined number of gate lines or a selected number of gate lines.

Figure 4A:
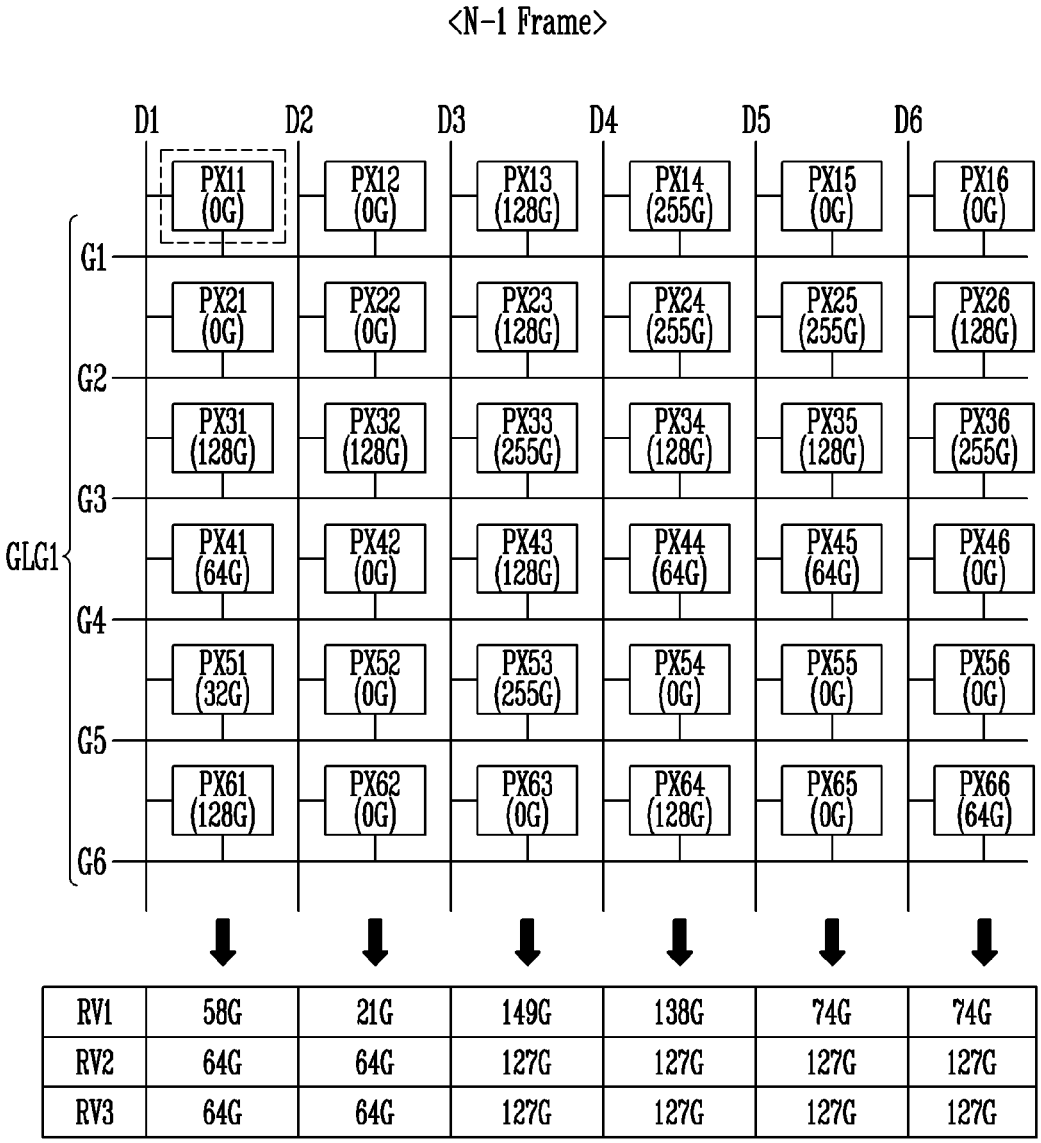
FIGS. 4A to 4D are diagrams illustrating pre-charging gray scale values calculated or obtained by a timing controller included in the display device of FIG. 1.
Figure 4B:
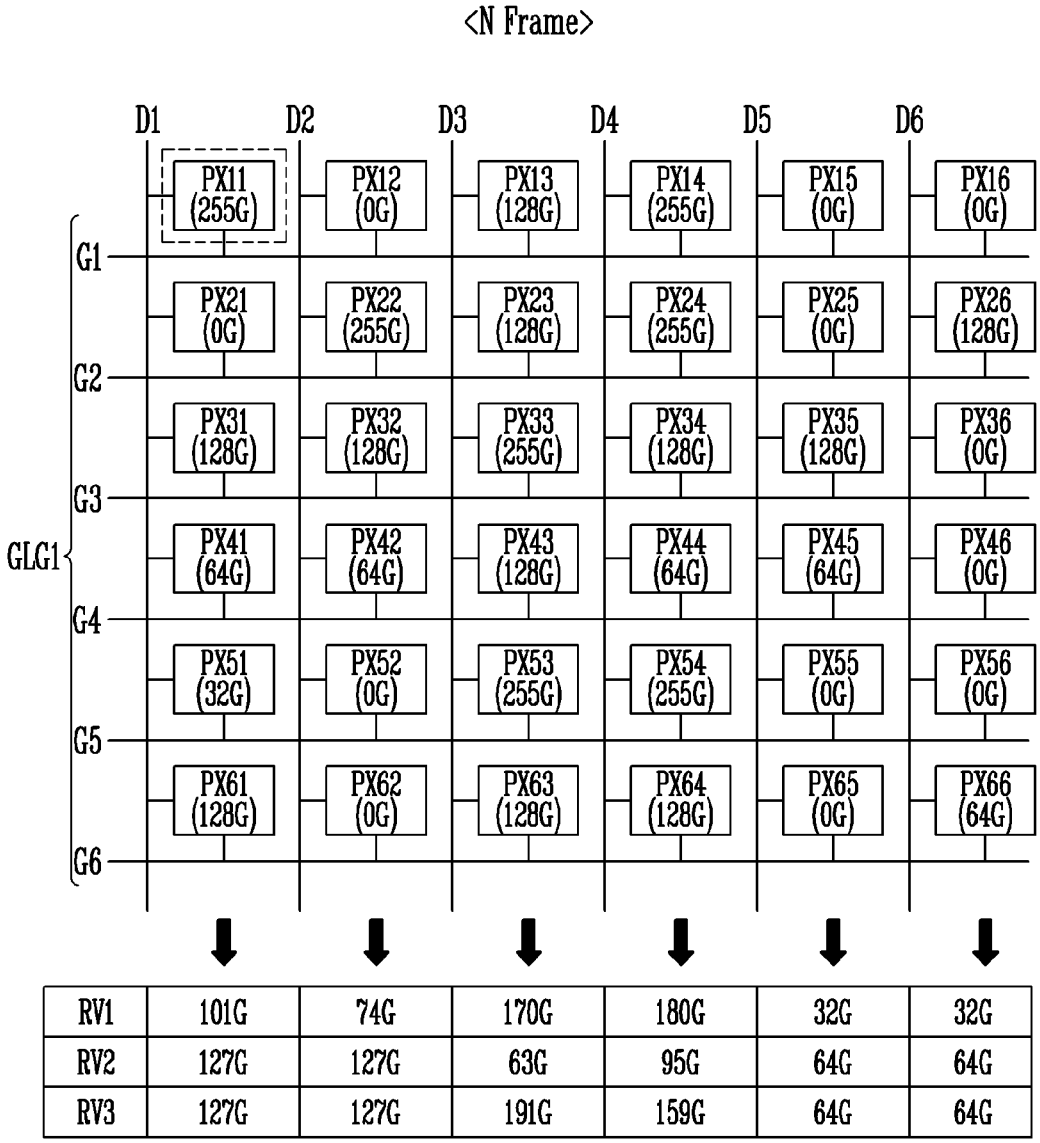

For example, in the first period P11, the gate driver 120 may simultaneously supply first to sixth gate signals GATE1, GATE2, . . . , GATE6 each having a turn-on level to first to sixth gate lines G1 to G6 (refer to FIGS. 4A and 4B) included in a first gate line group GLG1 (refer to FIGS. 4A and 4B). In the second period P12, the gate driver 120 may sequentially supply first to sixth gate signals GATE1, GATE2, . . . , GATE6 each having a turn-on level to the first to sixth gate lines G1 to G6 (refer to FIGS. 4A and 4B).

The data driver 130 may supply data voltages corresponding to pre-charging gray scale values in the first period P11 and supply data voltages corresponding to the gray scale values of the pixels in the second period P12.

In this case, pixels electrically connected to or electrically coupled to the first gate line group GLG1 (refer to FIGS. 4A and 4B) and the data lines D1, D2, . . . , Dm may be pre-charged in the first period P11, and may be charged with corresponding or respective data voltages in the second period P12. Hence, the charging rate of the pixels may be enhanced. Detailed operation of the data driver 130 will be described below with reference to FIGS. 4A and 4B.

In an embodiment, the pulse widths of the gate signals GATE1, GATE2, . . . , GATE6 that may be simultaneously supplied in the first period P11 may be the same as the pulse widths of the gate signals GATE1, GATE2, . . . , GATE6 that may be sequentially supplied in the second period P12. In other words, the width of the first gate-on time GOT1 may be the same as that of the second gate-on time GOT2. However, this is only for illustrative purposes, and the disclosure is not limited thereto. For example, the pulse widths of the gate signals GATE1, GATE2, . . . , GATE6 that may be simultaneously supplied in the first period P11 may be less than the pulse widths of the gate signals GATE1, GATE2, . . . , GATE6 that may be sequentially supplied in the second period P12. In other words, the width of the first gate-on time GOT1 may be less than that of the second gate-on time GOT2. Hence, the time (for example, the second gate-on time GOT2) for which each pixel may be individually charged with the corresponding or respective data voltage may be increased, whereby the charging rate of the pixel may be further enhanced.

A load signal TP, gate clock signals GCLK1 to GCLK6, and gate signals GATE7, GATES, . . . in the second sub-frame period SF2 may be substantially equal or similar to the load signal TP, the gate clock signals GCLK1 to GCLK6, and the gate signals GATE1 to GATE6 in the first sub-frame period SF1; therefore repetitive explanation thereof will be omitted.

Although FIG. 3A illustrates that the number of gate clock signals GCLK1 to GCLK6 is six, this is only for illustrative purposes, and the disclosure is not limited thereto. For example, the number of gate clock signals may be four or eight. For instance, if the number of gate clock signals is eight, turn-on level pulses included in first to eighth gate signals may be formed in the first sub-frame period, and logic high level pulses included in ninth to sixteenth gate signals may be formed in the second sub-frame period.

As described with reference to FIG. 1 to FIG. 3A, in the display device 100 in accordance with an embodiment, the gate lines G1, G2, . . . , Gn may be divided into gate line groups GLG1, GLG2, . . . (refer to FIGS. 4A to 4D). The gate driver 120 may simultaneously supply, during the first period P11, first to sixth gate signals GATE1 to GATE6 to gate lines (for example, first to sixth gate lines G1 to G6) included in one of the gate line groups GLG1, GLG2, . . . (refer to FIGS. 4A to 4D), and may sequentially supply, during the second period P12, the first to sixth gate signals GATE1 to GATE6 thereto. Hence, during the first gate-on time GOT1 and the second gate-on time GOT2, the switching transistor (or the second transistor M2) of each pixel described with reference to FIG. 2 may remain turned on. During the first gate-on time GOT1, the data driver 130 may supply data voltages corresponding to pre-charging gray scale values to the pixels so that the pixels may be simultaneously pre-charged. During the second gate-on time GOT2, the data driver 130 may supply, to the pixels, data voltages corresponding to the gray scale values of the pixels so that the pixels may be individually charged with the corresponding data voltages. Hence, the charging rate of the pixels may be enhanced.

Referring to FIG. 3B, each frame of FIG. 3B may not include the first period P11 described with reference to FIG. 3A. In other words, turn-on level pulses included in the gate clock signals GCLK1 to GCLK6 may not be simultaneously formed in a same section. Hence, turn-on level pulses included in the gate signal GATE1 to GATE12 may also not be simultaneously formed in a same section. Each of the gate signals GATE1 to GATE12 may have a turn-on level pulse only during the third gate-on time GOT3. Therefore, only during the third gate-on time GOT3, the switching transistor of each pixel may remain turned on, so that the pixel may be charged only during the third gate-on time GOT3.

For example, if the number of gate lines G1, G2, . . . , Gn is 4320 and a driving frequency is about 120 Hz, the third gate-on time GOT3 in accordance with the comparative example may be about 1.35 μs. Hence, the time for which each of the pixels is charged may be about 1.35 μs. On the other hand, in accordance with an embodiment, the first gate-on time GOT1 and the second gate-on time GOT2 each may be about 1.21 μs. Therefore, the time for which the pixels may be charged may be about 2.42 μs.

As described with reference to FIGS. 1 to 3B, the switching transistor (or the second transistor M2) of each pixel may be turned on during the first gate-on time GOT1 (for example, the time for which the pixels may be simultaneously charged or pre-charged) of the first period P11, P21, . . . , and the second gate-on time GOT2 (for example, the time for which the pixels may be individually charged) of the second period P12, P22, . . . . Consequently, the pixels may be pre-charged with data voltages corresponding to pre-charging gray scale values, so that the charging rate of each pixel may be enhanced.

Figure 3C:
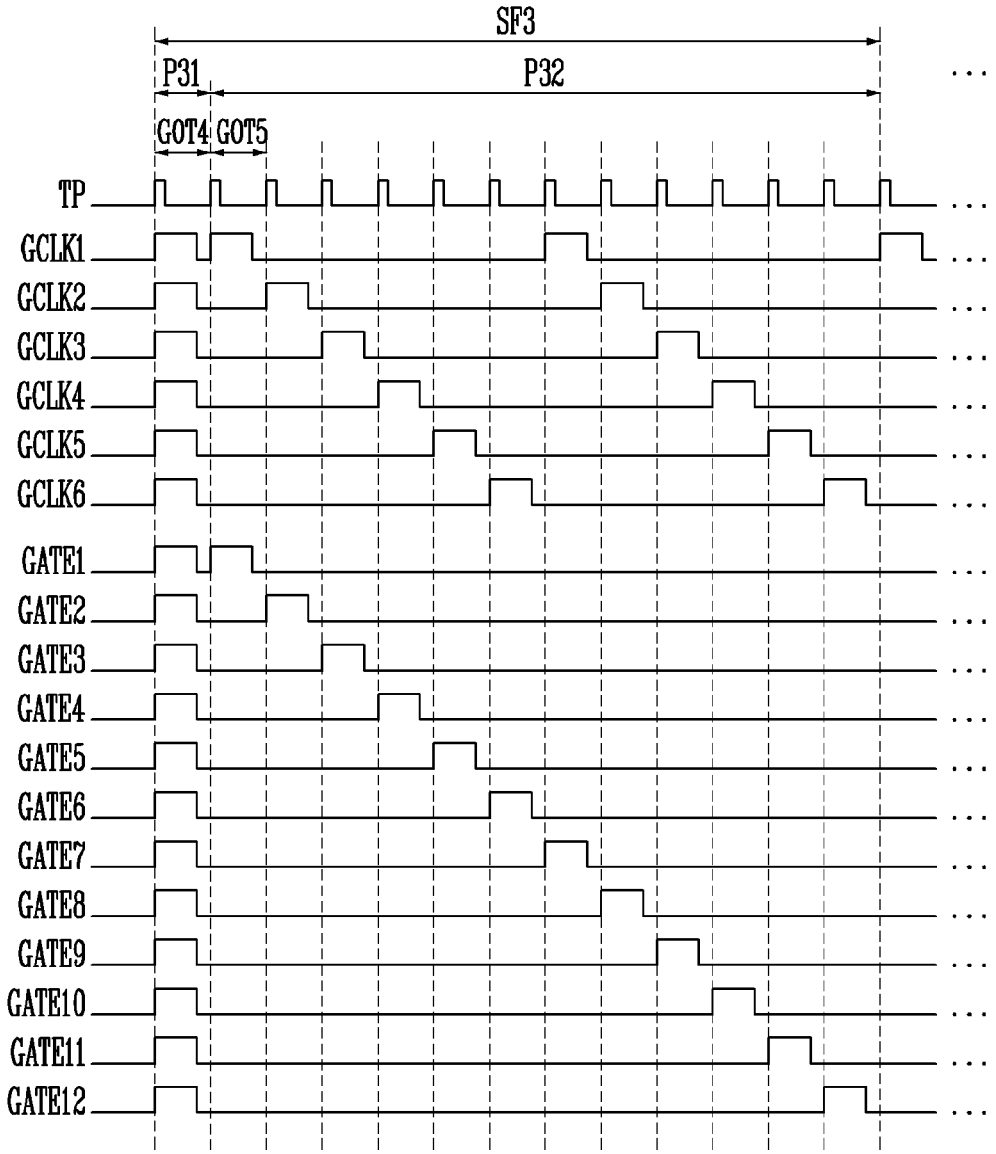
FIG. 3C is a waveform diagram illustrating a load signal, gate clock signals, and gate signals that are measured in the display device of FIG. 1 in accordance with an embodiment.

FIG. 3C is a waveform diagram illustrating a load signal, gate clock signals, and gate signals that may be measured in the display device of FIG. 1 in accordance with an embodiment.

Referring to FIGS. 3A and 3C, in sections other than a section in which gate clock signals GCLK1 to GCLK6 and gate signals GATE1, GATE2, . . . may be simultaneously formed, a load signal TP, gate clock signals GCLK1 to GCLK6, and gate signals GATE1, GATE2, . . . of FIG. 3C may be respectively substantially equal or similar to the load signal TP, the gate clock signals GCLK1 to GCLK6, and the gate signals GATE1, GATE2, . . . ; therefore, repetitive explanation thereof will be omitted.

Referring to FIGS. 1 and 3C, turn-on level pulses included in the gate clock signals GCLK1 to GCLK6 may be simultaneously formed in the first period P31. The turn-on level pulses included in the gate clock signals GCLK1 to GCLK6 may be sequentially formed two times in the second period P32.

Based on the gate clock signals GCLK1 to GCLK6, the gate driver 120 may simultaneously supply first to twelfth gate signals GATE1 to GATE12 to the first to twelfth gate lines in the first period P31, and sequentially supply the first to twelfth gate signals GATE1 to GATE12 to the first to twelfth gate lines in the second period P32.

The width of each of a fourth gate-on time GOT4 and a fifth gate-on time GOT5 may be greater than the width of each of the first gate-on time GOT1 and the second gate-on time GOT2 described with reference to FIG. 3A.

As such, in the case where the timing controller 110 generates first to q-th (q may be a natural number of 2 or more) gate clock signals, the number of gate lines included in the gate line groups GLG1, GLG2, . . . (refer to FIGS. 4A to 4D) may be a multiple of q. Based on the first to q-th gate clock signals, the gate driver 120 may simultaneously supply first to r-th gate signals to the first to r-th (r may be a multiple of q) in the first period, and sequentially supply first to r-th gate signals to the first to r-th gate lines in the second period. For example, in the case where the timing controller 110 generates first to sixth gate clock signals GCLK1 to GCLK6, the number of gate lines G1 to G12 (refer to FIGS. 4A to 4D) included in the gate line groups GLG1, GLG2, . . . (refer to FIGS. 4A to 4D) may be 12. However, this is only for illustrative purposes, and the disclosure is not limited thereto. For example, in the case where the timing controller 110 may generate first to sixth gate clock signals GCLK1 to GCLK6, the number of gate lines included in the gate line groups GLG1, GLG2, . . . may be 18 or 24. In this case, the number of gate signals that may be simultaneously supplied to the gate lines in the first period may be increased, so that the gate-on time (for example, the fourth gate-on time GOT4 and the fifth gate-on time GOT5 may be increased.

As described with reference to FIG. 3C, the number of gate signals GATE1 to GATE12 that may be simultaneously supplied to the gate lines in the first period P31 may be increased so that the gate-on time GOT4, GOT5 may be increased. Therefore, the charging rate (or the charging time) of each pixel may be further increased.

FIGS. 4A to 4D are diagrams illustrating pre-charging gray scale values calculated or obtained by the timing controller 110 included in the display device 100 of FIG. 1.

FIGS. 4A and 4B each illustrate first to sixth gate lines G1 to G6 included in the first gate line group GLG1, first to sixth data lines D1 to D6, and pixels PX11 to PX66 electrically connected to or electrically coupled to the first to sixth gate lines G1 to G6 and the first to sixth data lines D1 to D6. FIG. 4A illustrates gray scale values and pre-charging scale values RV1, RV2, and RV3 that correspond to data voltages supplied to the respective pixels PX11 to PX66 in a previous frame N−1 Frame. Similarly, FIG. 4B illustrates gray scale values and pre-charging scale values RV1, RV2, RV3 that correspond to data voltages supplied to the respective pixels PX11 to PX66 in a current frame N Frame.

Referring to FIGS. 1, 3A, and 4A, in the previous frame N−1 Frame, during the first period P11, P21, . . . in which the gate driver 120 may simultaneously supply gate signals to some gate lines of the gate lines G1, G2, . . . , Gn, the data driver 130 may supply data voltages corresponding to the pre-charging gray scale values RV1, RV2, RV3 to the data lines. For example, during the first sub-frame period SF1, in the first period P11 in which the gate driver 120 may simultaneously supply first to sixth gate signals GATE1 to GATE6 to the first to sixth gate lines G1 to G6 included in the first gate line group GLG1, the data driver 130 may supply a data voltage corresponding to a pre-charging gray scale value RV1, RV2, RV3 to the first data line D1. Similarly, in the first period P11, the data driver 130 may supply data voltages corresponding to the pre-charging gray scale values RV1, RV2, RV3 to the second to sixth data lines D2 to D6.

In the second period P12, P22, . . . in which the gate driver 120 may sequentially supply gate signals to the some gate lines, the data driver 130 may supply data voltages corresponding to the gray scale values of the pixels PX11 to PX66 to the data lines. For example, during the first sub-frame period SF1, in the second period P12 in which the gate driver 120 may sequentially supply the first to sixth gate signals GATE1 to GATE6 to the first to sixth gate lines G1 to G6, the data driver 130 may sequentially (or successively)

supply, to the first data line D1, data voltages corresponding to gray scale 0 (0G), gray scale 0 (0G), gray scale 128 (128G), gray scale 64 (64G), gray scale 32 (32G), and gray scale 128 (128G). Similarly, in the second period P12, the data driver 130 may supply data voltages corresponding to the gray scale values of the pixels to the second to sixth data lines D2 to D6.

Similarly, referring to FIGS. 1, 3A, and 4B, in the current frame N Frame, the data driver 130 may supply, to the data lines D1 to D6, data voltages corresponding to the pre-charging gray scale values RV1, RV2, and RV3 and data voltages corresponding to the gray scale values of the pixels PX11 to PX66 during the first period P11, P21, . . . and the second period P12, P22, . . . .

Referring to FIGS. 1 and 4A, as described with reference to FIG. 1, the timing controller 110 may calculate or obtain pre-charging gray scale values RV1, RV2, and RV3 based on the gray scale values of the pixels. Here, the pre-charging gray scale values RV1, RV2, and RV3 may be calculated or obtained based on the gray scale values of pixels that may be electrically connected to or electrically coupled both to gate lines included in a corresponding gate line group and to a corresponding data line. For example, the pre-charging gray scale values RV1, RV2, and RV3 corresponding to a data voltage supplied to the first data line D1 may be calculated or obtained based on the gray scale values 0G, 0G, 128G, 64G, 32G, and 128G of the pixels PX11 to PX61 electrically connected to or electrically coupled to the first data line D1 and the first to sixth gate lines G1 to G6 included in the first gate line group GLG1. Similarly, the pre-charging gray scale values RV1, RV2, and RV3 corresponding to a data voltage supplied to the second data line D2 may be calculated or obtained based on the gray scale values 0G, 0G, 128G, 0G, 0G, and 0G of the pixels PX12 to PX62 electrically connected to or electrically coupled to the second data line D2 and the first to sixth gate lines G1 to G6 included in the first gate line group GLG1. The pre-charging gray scale values RV1, RV2, and RV3 corresponding to a data voltage supplied to each of the third to sixth data lines D3 to D6 may also be calculated or obtained in a manner similar to that of calculating or obtaining the pre-charging gray values RV1, RV2, and RV3 corresponding to a data voltage supplied to each of the first and second data lines D1 and D2.

In an embodiment, the pre-charging gray scale values RV1, RV2, RV3 may include at least one of the first to third pre-charging gray scale values RV1 RV2, and RV3.

The first pre-charging gray scale values RV1 each may be calculated or obtained to be an average value of the gray scale values of pixels that may be electrically connected to or electrically coupled both to gate lines included in a corresponding gate line group and to a corresponding data line. For example, the first pre-charging gray scale value RV1 corresponding to a data voltage supplied to the first data line D1 may be calculated or obtained to be gray scale 58 (58G) that is an average value of gray scale 0 (0G), gray scale 0 (0G), gray scale 128 (128G), gray scale 64 (64G), gray scale 32 (32G), and gray scale 128 (128G) that may be gray scale values of the pixels PX11 to PX61 electrically connected to or electrically coupled to the first data line D1 and the first to sixth gate lines G1 to G6 included in the first gate line group GLG1. For example, the first pre-charging gray scale value RV1 corresponding to a data voltage supplied to the second data line D2 may be calculated or obtained to be gray scale 21 (21G) that is an average value of gray scale 0 (0G), gray scale 0 (0G), gray scale 128 (128G), gray scale 0 (64G), gray scale 0 (0G), gray scale 0 (0G) that may be gray scale values of the pixels PX12 to PX62 electrically connected to or electrically coupled to the second data line D2 and the first to sixth gate lines G1 to G6 included in the first gate line group GLG1. The first pre-charging gray scale values RV1 corresponding to data voltages supplied to the third to sixth data lines D3 to D6 may be calculated or obtained in a manner similar to that of calculating or obtaining the first pre-charging gray scale values RV1 corresponding to the data voltages supplied to the first and second data lines D1 and D2, and may be respectively calculated or obtained to be gray scale 149 (149G), gray scale 138 (138G), gray scale 74 (74G), and gray scale 74 (74G).

The second pre-charging gray scale values RV2 each may be calculated or obtained to be a half of a value obtained by subtracting a minimum value from a maximum value of the gray scale values of pixels that may be electrically connected to or electrically coupled both to gate lines included in a corresponding gate line group and to a corresponding data line. For example, the second pre-charging gray scale value RV2 corresponding to a data voltage supplied to the first data line D1 may be calculated or obtained to be gray scale 64 (64G) that is a half of a value obtained by subtracting gray scale 0 (0G) that is the minimum value from gray scale 128 (128G) that is the maximum value among gray scale 0 (0G), gray scale 0 (0G), gray scale 128 (128G), gray scale 64 (64G), gray scale 32 (32G), and gray scale 128 (128G) that may be gray scale values of the pixels PX11 to PX61 electrically connected to or electrically coupled to the first data line D1 and the first to sixth gate lines G1 to G6 included in the first gate line group GLG1. Similarly, the second pre-charging gray scale value RV2 corresponding to a data voltage supplied to the second data line D2 may be calculated or obtained to be gray scale 64 (64G) that is a half of a value obtained by subtracting gray scale 0 (0G) that is the minimum value from gray scale 128 (128G) that is the maximum value among gray scale 0 (0G), gray scale 0 (0G), gray scale 128 (128G), gray scale 0 (64G), gray scale 0 (0G), gray scale 0 (0G) that may be gray scale values of the pixels PX12 to PX62 electrically connected to or electrically coupled to the second data line D2 and the first to sixth gate lines G1 to G6 included in the first gate line group GLG1. The second pre-charging gray scale values RV2 corresponding to data voltages supplied to the third to sixth data lines D3 to D6 may be calculated or obtained in a manner similar to that of calculating or obtaining the second pre-charging gray scale values RV2 corresponding to the data voltages supplied to the first and second data lines D1 and D2, and may be respectively calculated or obtained to be gray scale 127 (127G), gray scale 127 (127G), gray scale 127 (127G), and gray scale 127 (127G).

The third pre-charging gray scale values RV3 each may be calculated or obtained to be an average value of a maximum value and a minimum value of the gray scale values of pixels that may be electrically connected to or electrically coupled both to gate lines included in a corresponding gate line group and to a corresponding data line. For example, the third pre-charging gray scale value RV3 corresponding to a data voltage supplied to the first data line D1 may be calculated or obtained to be gray scale 64 (64G) that is an average value of gray scale 128 (128G) that is the maximum value and gray scale 0 (0G) that is the minimum value among gray scale 0 (0G), gray scale 0 (0G), gray scale 128 (128G), gray scale 64 (64G), gray scale 32 (32G), and gray scale 128 (128G) that may be gray scale values of the pixels PX11 to PX61 electrically connected to or electrically coupled to the first data line D1 and the first to sixth gate lines G1 to G6 included in the first gate line group GLG1. Similarly, the third pre-charging gray scale value RV3 corresponding to a data voltage supplied to the second data line D2 may be calculated or obtained to be gray scale 64 (64G) that is an average value of gray scale 128 (128G) that is the maximum value and gray scale 0 (0G) that is the minimum value among gray scale 0 (0G), gray scale 0 (0G), gray scale 128 (128G), gray scale 0 (64G), gray scale 0 (0G), gray scale 0 (0G) that may be gray scale values of the pixels PX12 to PX62 electrically connected to or electrically coupled to the second data line D2 and the first to sixth gate lines G1 to G6 included in the first gate line group GLG1. The third pre-charging gray scale values RV3 corresponding to data voltages supplied to the third to sixth data lines D3 to D6 may be calculated or obtained in a manner similar to that of calculating or obtaining the third pre-charging gray scale values RV3 corresponding to the data voltages supplied to the first and second data lines D1 and D2, and may be respectively calculated or obtained to be gray scale 127 (127G), gray scale 127 (127G), gray scale 127 (127G), and gray scale 127 (127G).

Referring to FIGS. 1, 3A, 4A, and 4B, in a manner similar to that described with reference to FIGS. 1, 3A and 4A, pre-charging gray scale values RV1, RV2, and RV3 calculated or obtained in the current frame N Frame of FIG. 4B may be substantially equal or similar to the pre-charging gray scale values RV1, RV2, and RV3 calculated or obtained in the previous frame N−1 Frame of FIG. 4A; therefore, repetitive explanation thereof will be omitted.

Referring to FIG. 4B, the first pre-charging gray scale values RV1 calculated or obtained in the current frame N Frame may be respectively gray scale 101 (101G), gray scale 74 (74G), gray scale 170 (170G), gray scale 180 (180G), gray scale 32 (32G), and gray scale 32 (32G). The second pre-charging gray scale values RV2 calculated or obtained in the current frame N Frame may be respectively gray scale 127 (127G), gray scale 127 (127G), gray scale 63 (63G), gray scale 95 (95G), gray scale 64 (64G), and gray scale 64 (64G). The third pre-charging gray scale values RV3 calculated or obtained in the current frame N Frame may be respectively gray scale 127 (127G), gray scale 127 (127G), gray scale 191 (191G), gray scale 159 (159G), gray scale 64 (64G), and gray scale 64 (64G).

Figure 4C:
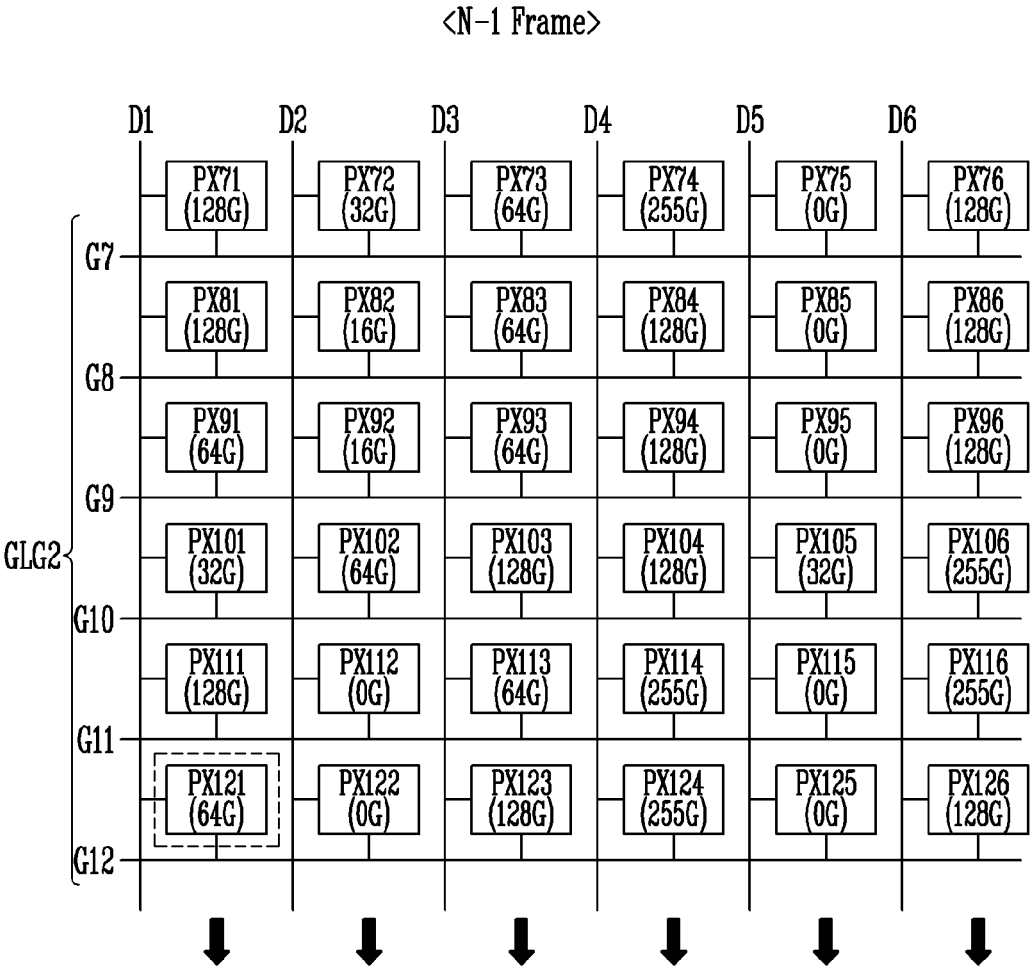
Figure 4D:
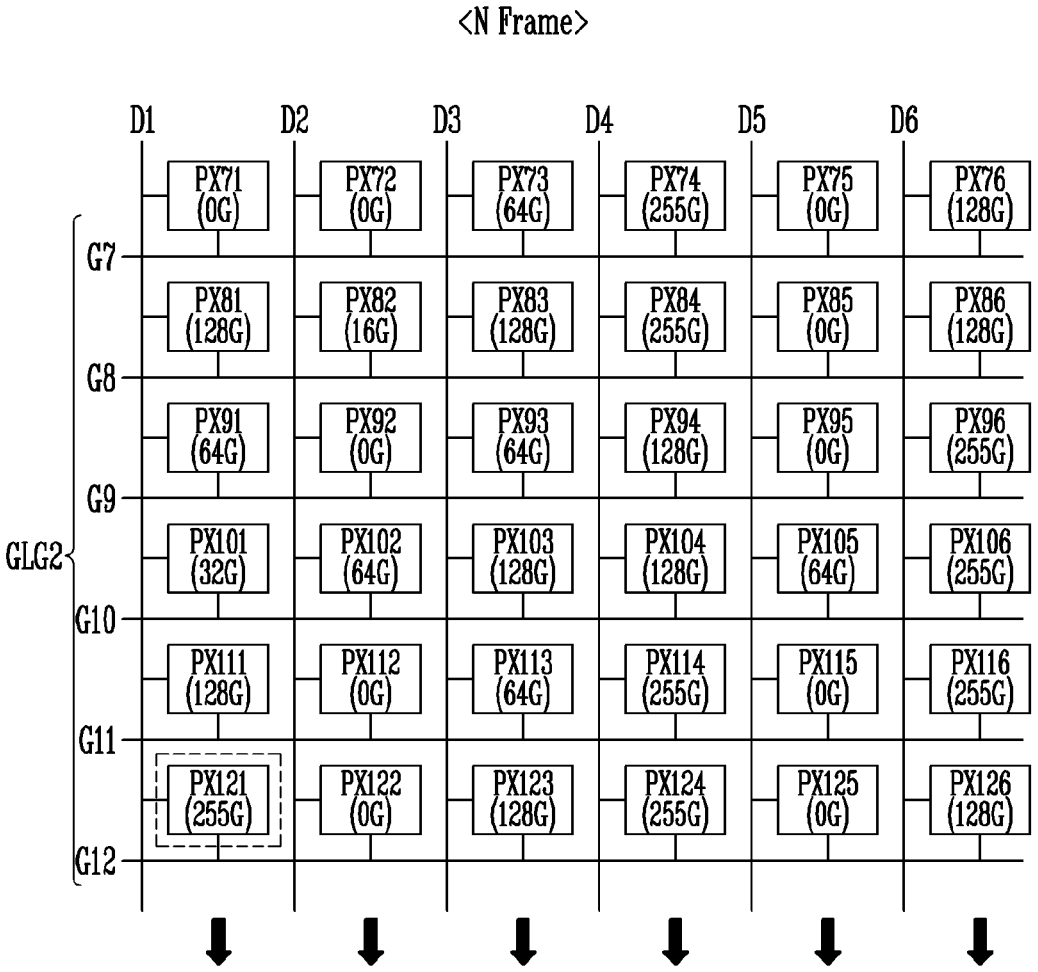

Referring to FIGS. 4A to 4D, a method of calculating or obtaining the pre-charging gray scale values RV1, RV2, and RV3 based on the gray scale values of the pixels PX71 to PX126 of FIGS. 4C and 4D, other than the configuration of the pixels PX71 to PX126 electrically connected to or electrically coupled to the second gate line group GLG2 of FIGS. 4C and 4D and seventh to twelfth gate lines G7 to G12, may be substantially equal or similar to the method of calculating or obtaining the pre-charging gray scale values RV1, RV2, and RV3 based on the gray scale values of the pixels PX11 to PX66 of FIGS. 4A and 4B; therefore, repetitive explanation thereof will be omitted.

FIGS. 4C and 4D each illustrate the seventh to twelfth gate lines G7 to G12 included in the second gate line group GLG2, the first to sixth data lines D1 to D6, and pixels PX71 to PX126 electrically connected to or electrically coupled to the seventh to twelfth gate lines G7 to G12 and the first to sixth data lines D1 to D6. FIG. 4C illustrates gray scale values and pre-charging scale values RV1, RV2, and RV3 that correspond to data voltages supplied to the respective pixels PX71 to PX126 in the previous frame N−1 Frame. Similarly, FIG. 4D illustrates gray scale values and pre-charging scale values RV1, RV2, and RV3 that correspond to data voltages supplied to the respective pixels PX71 to PX126 in a current frame N Frame.

In a manner similar to that described with reference to FIGS. 1, 3A, 4A, and 4B, the data driver 130 may supply, in the first period P11, P21, . . . , data voltages corresponding to pre-charging gray scale values RV1, RV2, RV3 to the first to sixth data lines D1 to D6, and may supply, in the second period P21, P22, . . . , data voltages corresponding to respective gray scale values of the pixels PX71 to PX126 to the first to sixth data lines D1 to D6.

In a manner similar to that described with reference to FIGS. 1, 3A, 4A, and 4B, the timing controller 110 may calculate or obtain pre-charging gray values RV1, RV2, and RV3 corresponding to data voltages supplied to the first to sixth data lines D1 to D6, based on the gray scale values of the pixels PX71 to PX126.

As illustrated in FIG. 4C, the first pre-charging gray scale values RV1 calculated or obtained in the previous frame N−1 Frame may be respectively gray scale 90 (90G), gray scale 21 (21G), gray scale 85 (85G), gray scale 191 (191G), gray scale 5 (5G), and gray scale 170 (170G). The second pre-charging gray scale values RV2 calculated or obtained in the previous frame N−1 Frame may be respectively gray scale 48 (48G), gray scale 32 (32G), gray scale 32 (32G), gray scale 63 (63G), gray scale 16 (16G), and gray scale 63 (63G). The third pre-charging gray scale values RV3 calculated or obtained in the previous frame N−1 Frame may be respectively gray scale 80 (80G), gray scale 32 (32G), gray scale 96 (96G), gray scale 191 (191G), gray scale 16 (16G), and gray scale 191 (191G). Similarly, as illustrated in FIG. 4D, the first pre-charging gray scale values RV1 calculated or obtained in the current frame N Frame may be respectively gray scale 101 (101G), gray scale 13 (13G), gray scale 96 (96G), gray scale 212 (212G), gray scale 10 (10G), and gray scale 191 (191G). The second pre-charging gray scale values RV2 calculated or obtained in the current frame N Frame may be respectively gray scale 127 (127G), gray scale 32 (32G), gray scale 32 (32G), gray scale 63 (63G), gray scale 32 (32G), and gray scale 63 (63G). The third pre-charging gray scale values RV3 calculated or obtained in the current frame N Frame may be respectively gray scale 127 (127G), gray scale 32 (32G), gray scale 96 (96G), gray scale 191 (191G), gray scale 32 (32G), and gray scale 191 (191G).

Referring to FIGS. 1, 3A, and 4A to 4D, the timing controller 110 may calculate or obtain at least one of the first to third pre-charging gray scale values RV1, RV2, and RV3 as a pre-charging gray scale value. Here, the calculated or obtained pre-charging gray scale value may be included in the data signal DATA. The data driver 130 may generate data voltages based on the data signal DATA that may include the pre-charging gray scale value, and provide data voltages corresponding to the pre-charging gray scale value to the corresponding data lines D1, D2, . . . , Dm in the first period P11, P21, . . . .

As described with reference to FIGS. 1, 3A, and 4A to 4D, the timing controller 110 may calculate or obtain pre-charging gray scale values RV1, RV2, RV3 based on the gray scale values of the pixels, and generate a data signal DATA based on the pre-charging gray scale values RV1, RV2, RV3. Hence, the data driver 130 may supply data voltages corresponding to the pre-charging gray scale values RV1, RV2, RV3 to the pixels and charge the pixels during the first period.

Figure 5A:
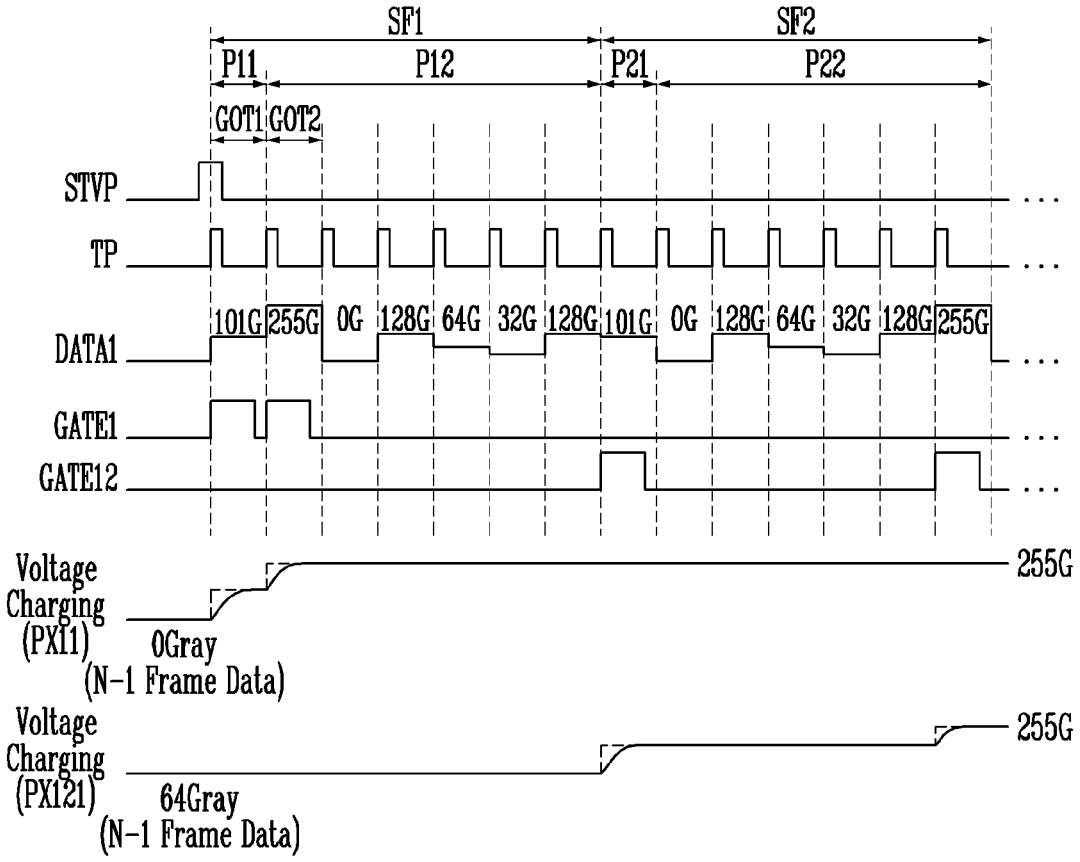
FIG. 5A is a waveform diagram illustrating a gate pulse start signal, a load signal, a data voltage, and a gate signal that are measured in the display device of FIG. 1, and voltages charged to pixels in accordance with an embodiment.
Figure 5B:
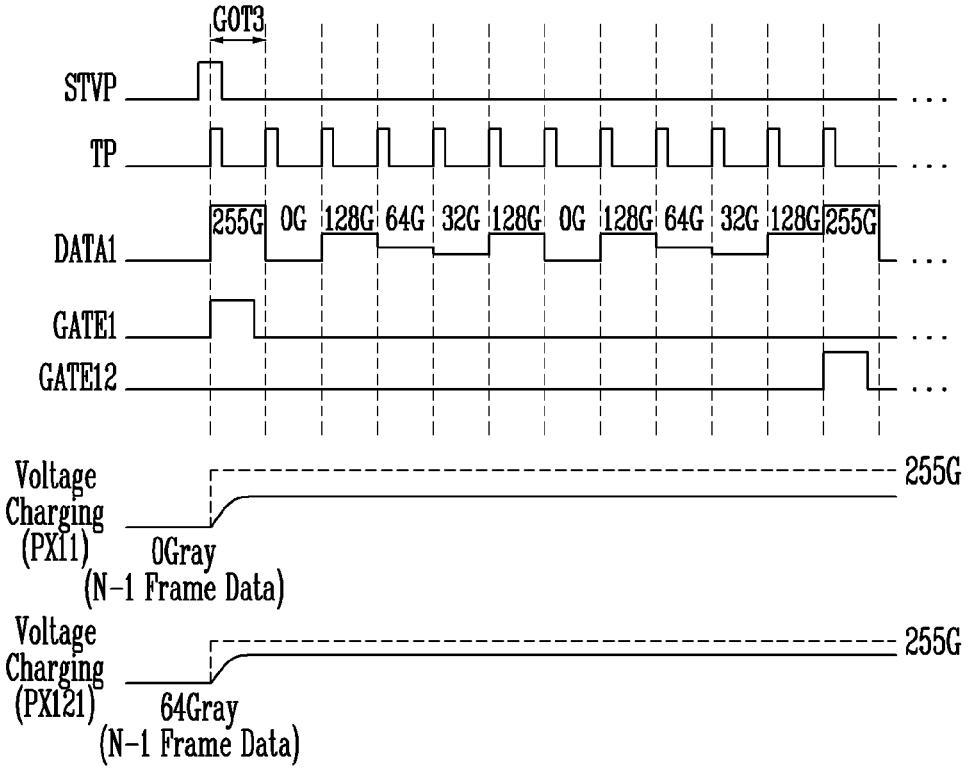
FIG. 5B is a waveform diagram illustrating a gate pulse start signal, a load signal, a data voltage, and a gate signal that are measured in the display device of FIG. 1, and voltages charged to pixels in accordance with a comparative example.

FIG. 5A is a waveform diagram illustrating a gate pulse start signal, a load signal, a data voltage, and a gate signal that may be measured in the display device of FIG. 1, and voltages charged to pixels in accordance with an embodiment. FIG. 5B is a waveform diagram illustrating a gate pulse start signal, a load signal, a data voltage, and a gate signal that may be measured in the display device of FIG. 1, and voltages charged to pixels in accordance with a comparative example.

Referring to FIGS. 3A and 5A, the load signal TP and the gate signals GATE1 and GATE12 of FIG. 5A may be substantially equal or similar to the load signal TP and the gate signals GATE1 and GATE12 of FIG. 3A; therefore, repetitive explanation thereof will be omitted.

Referring to FIG. 5A, the gate pulse start signal STVP may be generated based on a vertical start signal provided from the timing controller 110 (refer to FIG. 1) to the gate driver 120 (refer to FIG. 1). Before a time point at which each frame period starts, a logic high level pulse of the gate pulse start signal STVP may be generated. After the time point at which the frame period starts, the gate pulse start signal STVP may remain at a logic low level.

Referring to FIGS. 1, 3A, 4B, and 5A, a first data voltage DATA1 may be a data voltage which is supplied to the first data line D1. As described with reference to FIGS. 1 and 3A, the data driver 130 may generate the first data voltage DATA1 based on a load signal TP and a data signal DATA provided from the timing controller 110.

In an embodiment, the first data voltage DATA1 may be synchronized with the load signal TP. For example, the first data voltage DATA1 may be output in synchronization with rising edges of logic high level pulses included in the load signal TP.

The data driver 130 may successively supply the first data voltage DATA1 through the first data line D1. In detail, the data driver 130 may provide, to the first data line D1, a data voltage corresponding to gray scale 101 (101G) that may be a pre-charging gray scale value, in response to a rising edge of a first logic high level pulse included in the load signal TP. Hence, the data voltage corresponding to gray scale 101 (101G) may be supplied to the pixels PX11 to PX61 electrically connected to or electrically coupled to the first data line D1 and the first to sixth gate lines G1 to G6 included in the first gate line group GLG1.

The data driver 130 may sequentially (or successively) provide, to the first data line D1, data voltages corresponding to gray scale values of the pixels PX11 to PX61 electrically connected to or electrically coupled to the first data line D1 and the first to sixth gate lines G1 to G6, in response to rising edges of second to seventh logic high level pulses included in the load signal TP. Hence, data voltages corresponding to gray scale 255 (255G), gray scale 0 (0G), gray scale 128 (128G), gray scale 64 (64G), gray scale 32 (32G), and gray scale 128 (128G) may be respectively provided to the pixels PX11 to PX61.

Referring to FIGS. 4A, 4B, and 5A, in the previous frame N−1 Frame, the pixel PX11 electrically connected to or electrically coupled to the first data line D1 and the first gate line G1 may be charged with a data voltage corresponding to gray scale 0 (0G). Thereafter, in the first period P11 of the current frame N Frame, a first gate signal GATE1 may be applied to the first gate line G1, and a data voltage corresponding to gray scale 101 (101G) that may be a pre-charging gray scale value may be applied to the first data line D1. Thereby, the pixel PX11 may be pre-charged in response to gray scale 101 (101G). For example, in the second period P12, the first gate signal GATE1 may be applied to the first gate line G1, and a data voltage corresponding to gray scale 255 (255G) that may be a gray scale value of the pixel PX11 may be applied to the first data line D1. Hence, the pixel PX11 may be charged with a desired data voltage in response to gray scale 255 (255G).

Referring to FIG. 5B, each frame of FIG. 5B may not include the first period P11 described with reference to FIG. 5A. In other words, in the previous frame N−1 Frame, the pixel PX11 electrically connected to or electrically coupled to the first data line D1 and the first gate line G1 may be charged with a data voltage corresponding to gray scale 0 (0G). Thereafter, in the current frame N Frame, the first gate signal GATE1 may be applied to the first gate line G1, and a data voltage corresponding to gray scale 255 (255G) that may be a gray scale value of the pixel PX11 may be applied to the first data line D1. However, in the case where there is a great difference between the gray scale value (gray scale 0 (0G)) of the pixel PX11 of the previous frame N−1 Frame and the gray scale value (gray scale 255 (255G)) of the pixel PX11, the time (for example, the third gate-on time GOT3) for which the pixel PX11 may be charged may be insufficient, so that the pixel PX11 may not be charged with a data voltage corresponding to a desired gray scale value (gray scale 255 (255G)). On the other hand, as described with reference to FIG. 5A, in the case where the pixel PX11 may be pre-charged with a data voltage corresponding to the pre-charging gray scale value (gray scale 101 (101G)) in the first period P11 and may be individually charged with a data voltage corresponding to the gray scale value (gray scale 255 (255G)) of the pixel PX11 in the second period P12, the pixel PX11 may be charged with a data voltage corresponding to the desired gray scale value (gray scale 255 (255G)) even if there is a great difference between the gray scale value (gray scale 0 (0G)) of the pixel PX11 of the previous frame N−1 Frame and the gray scale value (gray scale 255 (255G)) of the pixel PX11 of the current frame N Frame.

Similarly, referring to FIGS. 4C, 4D, 5A, and 5B, with regard to the pixel P121 electrically connected to or electrically coupled to the first data line D1 and the twelfth gate line G12, in the case where the gray scale value of the pixel P121 of the previous frame N−1 Frame may be gray scale 64 (64G) and the gray scale value of the pixel P121 of the current frame N Frame may be gray scale 255 (255G), the pixel PX121 may be pre-charged with a data voltage corresponding to the pre-charging gray scale value (gray scale 101 (101G)) in the first period P21, and individually charged with a data voltage corresponding to the gray scale value (gray scale 255 (255G)) of the pixel PX121 in the second period P22. Thus, the pixel PX121 may be charged with a data voltage corresponding to the desired gray scale value (gray scale 255 (255G)).

As described with reference to FIGS. 5A and 5B, the pixels may be pre-charged with data voltages corresponding to pre-charging gray scale values in the first period P11, P21, . . . , and individually charged with data voltages corresponding to the gray scale values of the pixels in the second period P21, P22, . . . . Therefore, even if there is a great difference in gray scale values of the pixels between the previous frame and the current frame, the pixels may be charged with data voltages corresponding to desired gray scale values.

Figure 6:
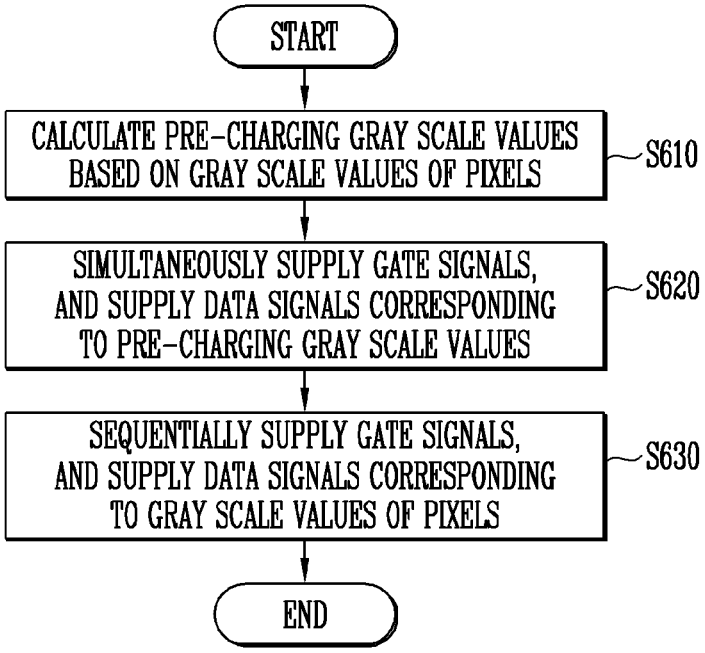
FIG. 6 is a flowchart illustrating a method of driving a display device in accordance with an embodiment.

FIG. 6 is a flowchart illustrating a method of driving a display device in accordance with an embodiment.

Referring to FIGS. 1 and 6, the method of driving the display device of FIG. 6 may be performed in the display device 100 of FIG. 1.

In the method of driving the display device of FIG. 6, pre-charging gray scale values may be calculated or obtained based on the gray scale values of the pixels (at step S610). Here, the pre-charging gray scale values may include at least one of the first to third pre-charging gray scale values RV1, RV2 and RV3 described with reference to FIGS. 4A to 4D.

Thereafter, in the method of driving the display device of FIG. 6, in the first period, gate signals may be simultaneously supplied to the gate lines, and data voltages corresponding to the pre-charging gray scale values may be supplied to the data lines (at step S620).

In an embodiment, in the method of driving the display device of FIG. 6, during the first period, gate signals may be simultaneously supplied to gate lines included in a p-th group (p may be a natural number of 1 or more and k or less), and data voltages corresponding to the pre-charging gray scale values may be supplied to the data lines. For example, as described with reference to FIGS. 1, 3A, and 4A to 4B, in the first period P11, P21, . . . , the gate driver 120 may simultaneously supply gate signals GATE1 to GATE6 to the first to sixth gate lines G1 to G6 included in the first gate line group GLG1, and the data driver 130 may supply data voltages corresponding to the pre-charging gray scale values RV1, RV2, and RV3 to the data lines D1 to D6.

In the method of driving the display device of FIG. 6, in the second period, gate signals may be sequentially supplied to the gate lines, and data signals corresponding to the gray scale values of the pixels may be supplied to the data lines (at step S630).

In an embodiment, in the method of driving the display device of FIG. 6, during the second period, the gate signals may be sequentially supplied to the gate lines included in the p-th group, and data signals corresponding to the gray scale values of the pixels may be supplied to the data lines. For example, as described with reference to FIGS. 1, 3A, and 4A to 4B, in the first period P12, P22, . . . , the gate driver 120 may sequentially supply gate signals GATE1 to GATE6 to the first to sixth gate lines G1 to G6 included in the first gate line group GLG1, and the data driver 130 may supply data voltages corresponding to the gray scale values of the pixels PX11 to PX66 to the data lines D1 to D6.

In a display device and a method of driving the display device in accordance with an embodiment, gate signals may be simultaneously supplied to at least some of gate lines (or a predetermined number of or selected number of gate lines) during a pre-charging period, and data voltages corresponding to pre-charging gray scale values may be supplied to data lines. Consequently, the charge rate of the pixels may be enhanced.

Example embodiments have been disclosed herein, and although terms are employed, they are used and are to be interpreted in a generic and descriptive sense only and not for purpose of limitation. In some instances, as would be apparent to one of ordinary skill in the art as of the filing of the application, features, characteristics, and/or elements described in connection with an embodiment may be used singly or in combination with features, characteristics, and/or elements described in connection with other embodiments unless otherwise specifically indicated. Accordingly, it will be understood by those of ordinary skill in the art that various changes in form and details may be made without departing from the spirit and scope of the disclosure as set forth in the following claims.

What is claimed is:

1. A display device comprising:

a display panel including gate lines, data lines, and pixels;

a gate driver that provides gate signals to the pixels through the gate lines;

a data driver that provides data signals to the pixels through the data lines; and a timing controller that obtains pre-charging gray scale values based on gray scale values of the pixels, wherein the gate driver simultaneously supplies the gate signals to the gate lines in a first period, and sequentially supplies the gate signals to the gate lines in a second period, and the data driver supplies data signals corresponding to the pre-charging gray scale values to the data lines in the first period, and supplies data signals corresponding to the gray scale values of the pixels to the data lines in the second period.

2. The display device of claim 1, wherein the gate driver simultaneously supplies the gate signals to a predetermined number of gate lines in the first period.

3. The display device according to claim 1, wherein the gate lines include first to k-th groups, and the gate driver simultaneously supplies the gate signals to gate lines included in a p-th group among the first to k-th groups in the first period, and sequentially supplies the gate signals to the gate lines included in the p-th group in the second period wherein k is a natural number of 2 or more, and p is a natural number of 1 or more.

4. The display device according to claim 3, wherein a first frame period includes first to k-th sub-frame periods, and a p-th sub-frame period among the first to k-th sub-frame periods includes the first period and the second period.

5. The display device according to claim 4, wherein a first pre-charging gray scale value corresponding to a data signal supplied to a first data line among the data lines is obtained based on gray scale values of pixels electrically connected to the first data line and the gate lines included in the p-th group.

6. The display device according to claim 5, wherein the first pre-charging gray scale value is an average value of the gray scale values of the pixels electrically connected to the first data line and the gate lines included in the p-th group.

7. The display device according to claim 5, wherein the first pre-charging gray scale value is a half of a value obtained by subtracting a minimum value of the gray scale values of the pixels electrically connected to the first data line and the gate lines included in the p-th group from a maximum value of the gray scale values.

8. The display device according to claim 5, wherein the first pre-charging gray scale value is an average value of a maximum value and a minimum value of the gray scale values of the pixels electrically connected to the first data line and the gate lines included in the p-th group.

9. The display device according to claim 4, wherein the timing controller generates first to q-th gate clock signals, and the gate driver generates the gate signals based on the first to q-th gate clock signals, wherein q is a natural number of 2 or more.

10. The display device according to claim 9, wherein each of the first to q-th gate clock signals includes pulses that are simultaneously formed in a same section during the first period, and are sequentially formed in different sections during the second period.

11. The display device according to claim 9, wherein the gate lines included in the p-th group are adjacent to each other, and a number of the gate lines included in the p-th group is a multiple of q.

12. The display device according to claim 4, wherein pulse widths of the gate signals that are simultaneously supplied to the gate lines included in the p-th group in the first period are equal to pulse widths of the gate signals that are sequentially supplied to the gate lines included in the p-th group in the second period.

13. The display device according to claim 4, wherein pulse widths of the gate signals that are simultaneously supplied to the gate lines included in the p-th group in the first period are less than pulse widths of the gate signals that are sequentially supplied to the gate lines included in the p-th group in the second period.

14. A method of driving a display device, comprising:

obtaining pre-charging gray scale values based on gray scale values of pixels;

simultaneously supplying gate signals to gate lines included in a p-th group among first to k-th groups in a first period;

supplying data signals corresponding to the pre-charging gray scale values to data lines in the first period;

sequentially supplying the gate signals to the gate lines included in the p-th group in a second period; and supplying data signals corresponding to gray scale values of the pixels to the data lines in the second period, wherein p is a natural number of 1 or more, and k is a natural number of 2 or more.

15. The method according to claim 14, wherein a first pre-charging gray scale value corresponding to a data signal supplied to a first data line among the data lines is an average value of gray scale values of pixels electrically connected to the first data line and the gate lines included in the p-th group.

16. The method according to claim 14, wherein a first pre-charging gray scale value corresponding to a data signal supplied to a first data line among the data lines is a half of a value obtained by subtracting a minimum value of gray scale values of pixels electrically connected to the first data line and the gate lines included in the p-th group from a maximum value of the gray scale values.

17. The method according to claim 14, wherein a first pre-charging gray scale value corresponding to a data signal supplied to a first data line among the data lines is an average value of a maximum value and a minimum value of gray scale values of pixels electrically connected to the first data line and the gate lines included in the p-th group.

18. The method according to claim 14, further comprising:

generating first to q-th gate clock signals; and generating the gate signals based on the first to q-th gate clock signals, wherein each of the first to q-th gate clock signals includes pulses that are simultaneously formed in a same section during the first period, and are sequentially formed in different sections during the second period, wherein q is a natural number of 2 or more.

19. The method according to claim 18, wherein the gate lines included in the p-th group are adjacent to each other, and a number of the gate lines included in the p-th group is a multiple of q.

20. The method according to claim 14, wherein pulse widths of the gate signals that are simultaneously supplied to the gate lines included in the p-th group in the first period are less than or equal to pulse widths of the gate signals that are sequentially supplied to the gate lines included in the p-th gate line group in the second period.

* * * * *